US007628214B2

(12) United States Patent
Stoesz et al.

(10) Patent No.: US 7,628,214 B2
(45) Date of Patent: Dec. 8, 2009

(54) AUTOMATIC CONTROL LINE INSERTION TOOLS AND SYSTEM

(75) Inventors: Carl W. Stoesz, Houston, TX (US); Stephen L. Crow, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 295 days.

(21) Appl. No.: 11/699,884

(22) Filed: Jan. 30, 2007

(65) Prior Publication Data

US 2007/0181200 A1 Aug. 9, 2007

Related U.S. Application Data

(60) Provisional application No. 60/765,900, filed on Feb. 6, 2006.

(51) Int. Cl.
*E21B 19/00* (2006.01)

(52) U.S. Cl. ..... 166/385; 166/85.5; 166/241.1

(58) Field of Classification Search ..... 166/378, 166/380, 358, 85.5, 241.1
See application file for complete search history.

(56) References Cited

U.S. PATENT DOCUMENTS

| | | | | |
|---|---|---|---|---|
| 2005/0045329 | A1 | 3/2005 | Wetzel et al. | |
| 2006/0065404 | A1 * | 3/2006 | Pennison et al. | 166/380 |

FOREIGN PATENT DOCUMENTS

| | | | |
|---|---|---|---|
| EP | 1255022 | A | 6/2002 |
| GB | 2284257 | A | 5/1995 |
| GB | 2382831 | A | 11/2003 |
| GB | 2409692 | A | 6/2005 |
| WO | 2004114487 | A1 | 12/2004 |
| WO | 2006003208 | A | 1/2006 |
| WO | 2005103437 | A | 3/2006 |
| WO | 2006076526 | A1 | 7/2006 |

OTHER PUBLICATIONS

PCT International Search Report, Application No. PCT/US2007/002965; Filing Date Jan. 2, 2007; Mailing Date Jun. 25, 2007.

SPE 86458, "Design, Installation and Results From the World's Longest Deep-Water Openhole, Shunt-Tube Gravel-Pack West of Shetlands"; Allan Wilson, Alistair Roy, Allan Twynam, SPE, BP; Daniel Ndzi Shirmboh and Garry Sinclair, SPE, Schlumberger; Feb. 18, 2004.

"Coiled Tubing . . . Operations and Services\ Part I- The Evolution of Coiled Tubing Equipment"; Alexander Sas-Jaworsky II; World Oil, Gulf Publishing Company, Houston, TX, US; vol. 212, No. 11, Nov. 1, 1991; pp. 41-44; 46.

* cited by examiner

*Primary Examiner*—David J Bagnell
*Assistant Examiner*—Elizabeth C Gottlieb
(74) *Attorney, Agent, or Firm*—Cantor Colburn LLP

(57) ABSTRACT

A system for inserting control lines to a control line receptacle at an alternate path structure including an upper guide having a path structure engagement roller, a control line insertion wheel and a control line bypass space. The system further includes a lower guide separate from the upper guide and having a path structure engagement roller and a control line insertion wheel. The path structure engagement roller and control line insertion wheel are resiliently biased to a position to cause control line insertion to the alternate flow path structure when in an engaged position. A method for inserting control lines is included.

21 Claims, 3 Drawing Sheets

AUTOMATIC CONTROL LINE INSERTION TOOLS AND SYSTEM

CROSS REFERENCE TO RELATED APPLICATIONS

This application claims priority to provisional application 60/765,900 filed Feb. 6, 2006, the entire contents of which are incorporated herein by reference.

BACKGROUND

In the hydrocarbon exploration and recovery art there is often a need to install control lines of one sort or another on strings being run in the well. Such control lines are generally desired to be connected in some way to the string to avoid damage thereto. While there have been different attempts to by hand or mechanically insert the lines there is much to be desired in efficient and competent installation of the control lines. To this end the art is always in need of alternate means that improve efficiency and reliability.

SUMMARY

Disclosed herein is a system for inserting control lines to a control line receptacle at an alternate path structure. The system includes an upper guide having a path structure engagement roller, a control line insertion wheel and a control line bypass space and further includes a lower guide separate from the upper guide and having a path structure engagement roller and a control line insertion wheel, the path structure engagement roller and control line insertion wheel being resiliently biased to a position calculated to cause control line insertion to said alternate flow path structure when in an engaged position.

Further disclosed herein is a control line insertion tool for inserting control line to a control line receptacle at an alternate flow path structure. The tool includes a frame, a path structure engagement roller in operable communication with the frame, and a handle in operable communication with the frame. The tool further includes a control line insertion wheel in operable communication with the handle and a retention arrangement that in a disengaged position allows movement of the handle relative to said frame and in an engaged position, restricts movement of the handle relative to the frame.

Yet further disclosed herein is a spring biased control line insertion tool for inserting a control line to a control line receptacle at an alternate flow path structure. The tool includes a control line insertion wheel, an alternate path structure engagement roller, a biasing arrangement in operable communication with the wheel and the roller, and the biasing arrangement, and a biasing arrangement in operable communication with the wheel and the roller toward one another.

Also disclosed herein is a method for inserting a plurality of control lines to a control line receptacle at an alternate flow path structure. The method includes separating a plurality of control lines supplied from a remote source, engaging one of the plurality of control lines with a control line insertion wheel of an upper control line guide and urging the engaged control line to the control line receptacle, bypassing at least one other control line of the plurality of control lines with the insertion wheel of the upper control line guide, and engaging one control line of the at least one other control line with a control line insertion wheel of a lower control line guide and urging the one control line of the at least one other control line to the control line receptacle.

DETAILED DESCRIPTION

Figure 1:
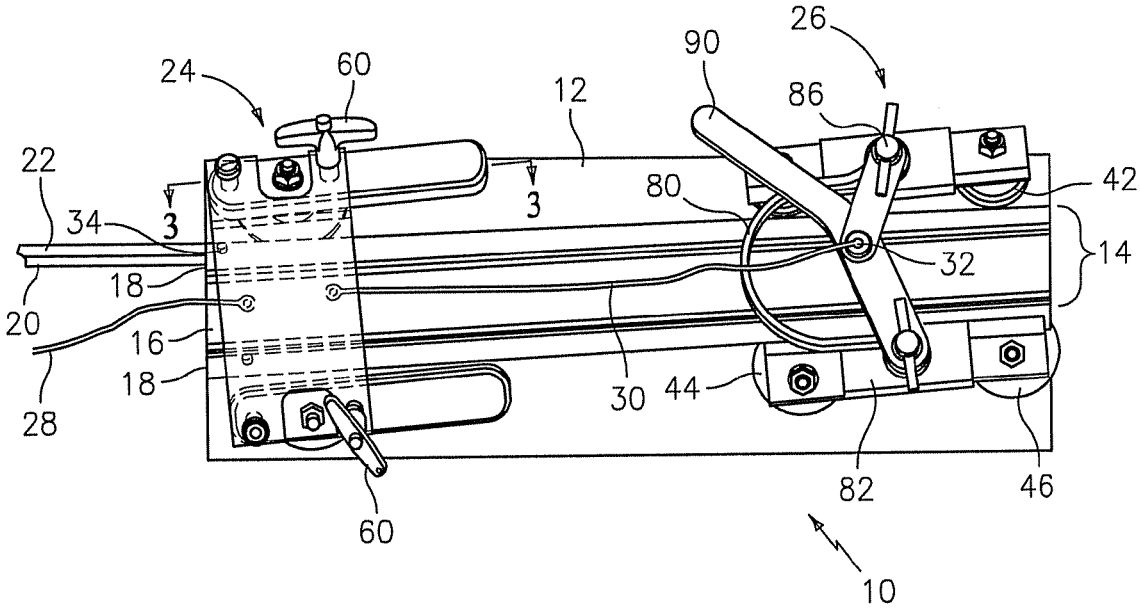
FIG. 1 is a schematic elevation view of a section of tubular having an alternate flow path and a set of guides in an engaged position.

Referring to FIG. 1, a system for inserting control lines to a control line receptacle at an alternate flow path structure is generally illustrated at 10. Numeral 12 denotes a tubular upon which an alternate flow path structure 14 is mounted. Tubular 12 may be any type of tubular or even other arrangement but commonly an alternate flow path structure is utilized with respect to a gravel packing apparatus and the tubular therefore is commonly a screen. For the embodiments discussed herein the alternate flow path structure 14 includes a passage 16, which might be used for a flow of material and at least one control line receptacle 18 (illustrated herein as two receptacles 18). The type of alternate flow path structure contemplated herein is similar to that described within U.S. Publication No. 2006/0219404 A1 filed on Jan. 12, 2006, which is incorporated herein by reference. Also visible within FIG. 1 are two control lines 20 and 22 being deposited within the control line receptacle 18 by upper guide (or tool) 24 and lower guide (or tool) 26. In one embodiment of the system, an upper guide 24 ("upper" is used only for distinctive purposes) inserts a first control line while bypassing a second control line. The second control line is then inserted by a lower guide 26 ("lower" is used only for distinctive purposes). In one embodiment, the upper guide 24 is tethered via tether 28 to a fixed distance structure such as the control line sheave (not shown). Tether 28 maintains upper guide 24 in a longitudinally fixed position but allows for it to move laterally relatively easily. Upper guide 24 is tethered to lower guide 26 by tether 30 to maintain a convenient distance between upper guide 24 and lower guide 26. In one embodiment it has been determined that less than eighteen inches is a convenient distance for appropriate operability. It should be further noted at this juncture the tether 30 connects to lower guide 26 at a pivot pin 32. This is important to be noted because if tether 30 is connected at pin 32 the normal frictional drag seen by lower guide 26 along the control line and the alternate flow path structure 14 is effectively translated to additional clamping force of lower guide 26 onto alternate flow path structure 14. The clamping force and the structure of lower guide 26 will be made more clear subsequently herein when the lower guide 26 is discussed in detail. One further point to be made with respect to FIG. 1 is that upper guide 24 includes a separation pin 34 whose purpose it is to prevent the control lines from crossing over one another prior to insertion. If such crossover should happen, it is possible that the control lines would become crushed during insertion.

Figure 2:
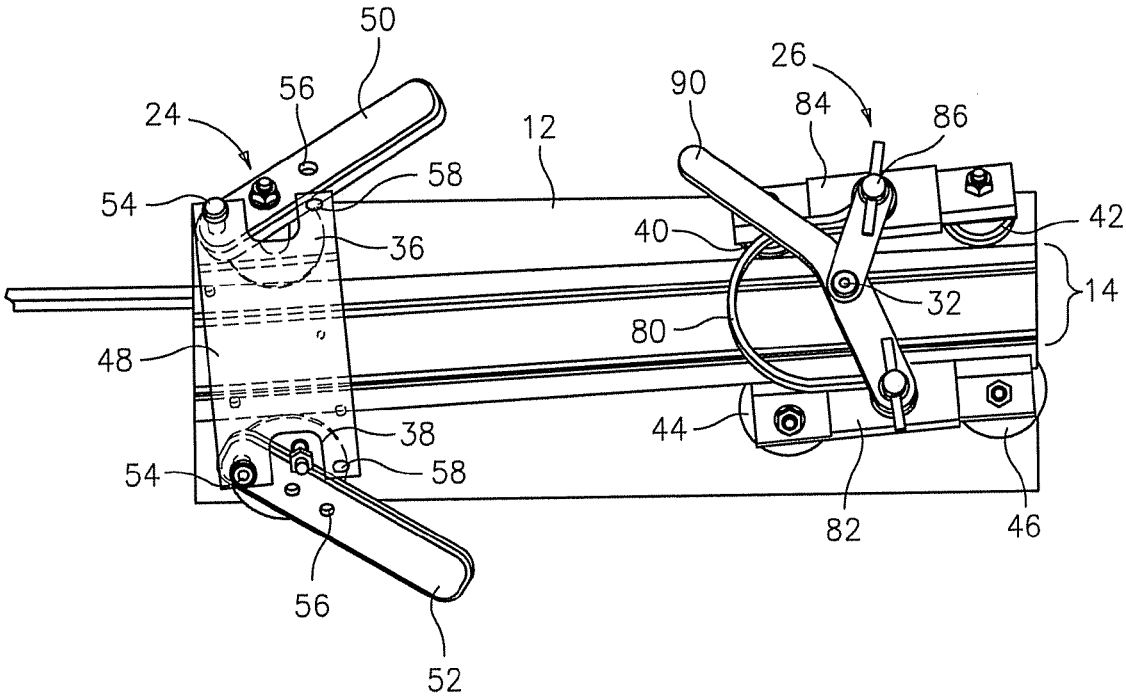
FIG. 2 is the view of FIG. 1 with the set of guides in an unengaged position.

Referring to FIG. 2, tubular 12 will be familiar as will be alternate flow path structure 14. These have not changed in configuration or location. It will be appreciated that upper guide 24 is illustrated in an alternate position from that of FIG. 1. It will also be appreciated that lower guide 26 is illustrated in an alternate position from that of FIG. 1. The positions illustrated for upper guide 24 and lower guide 26 in FIG. 2 are in the open position, which position allows the placement of the guides 24 and 26 over alternate flow path structure 14 prior to engagement therewith. It should be appreciated that control line insertion wheel 36 of upper guide 24 and alternate flow path structure engagement roller 38 are not positioned in engagement with the alternate flow path structure 14 or in contact with control lines 22 or 20. It should further be recognized that a first control line insertion wheel 40 of lower guide 26 and a second control line insertion wheel 42 of lower guide 26 are not in contact with control lines 20 or 22 in the illustration of FIG. 2. In order to insert lower guide 26 onto alternate flow path structure 14, the lack of contact allows the guide 26 to be placed over alternative flow path structure 14 prior to being engaged therewith. It will further be appreciated that the upper guide 24 and lower guide 26 engage the alternate flow path structure 14 differently from each other. Whereas wheel 36 and roller 28 of upper guide 24 are both out of engagement with alternate flow path structure 14 when being installed, lower guide 26 is illustrated with a pair of rollers 44 and 46 already engaged with alternate flow path structure 14. Only the control line insertion wheels 40 and 42 are disengaged in lower guide 26. This is because the lower guide 26 operates on a spring principle, which will be discussed hereinafter, when lower guide 26 is discussed in detail.

Figure 3:
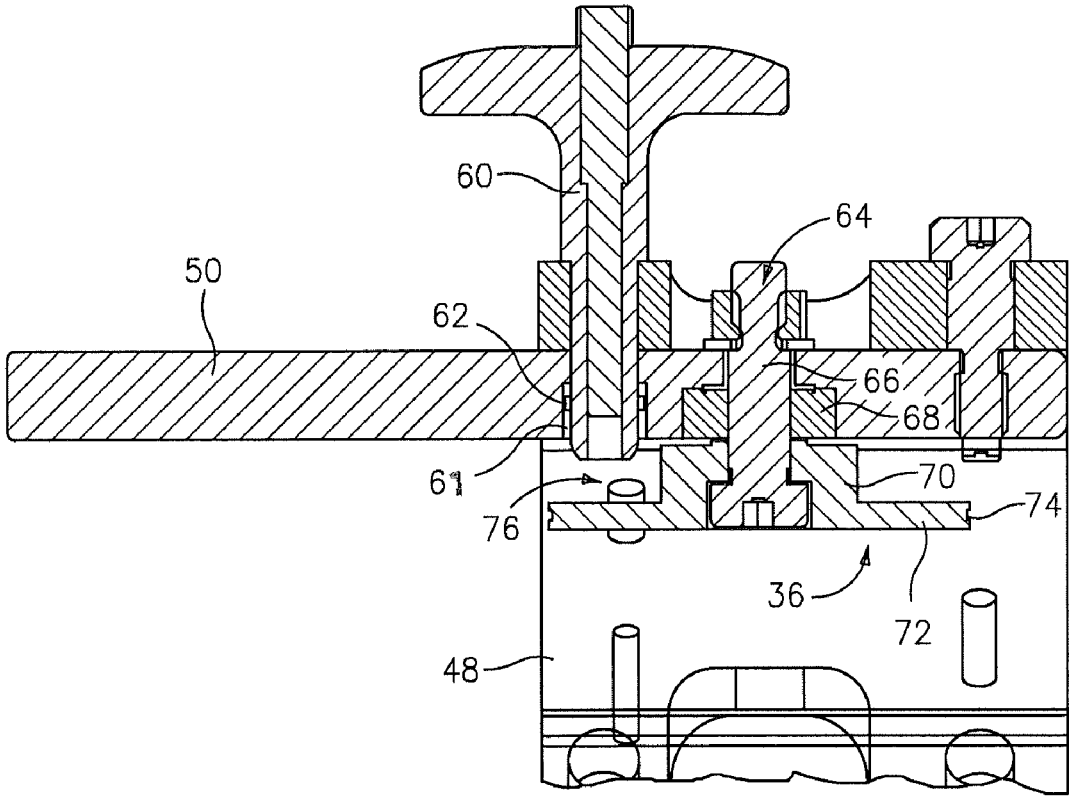
FIG. 3 is a cross-sectional view of the upper guide taken along section line 3-3 in FIG. 1.
Figure 4:
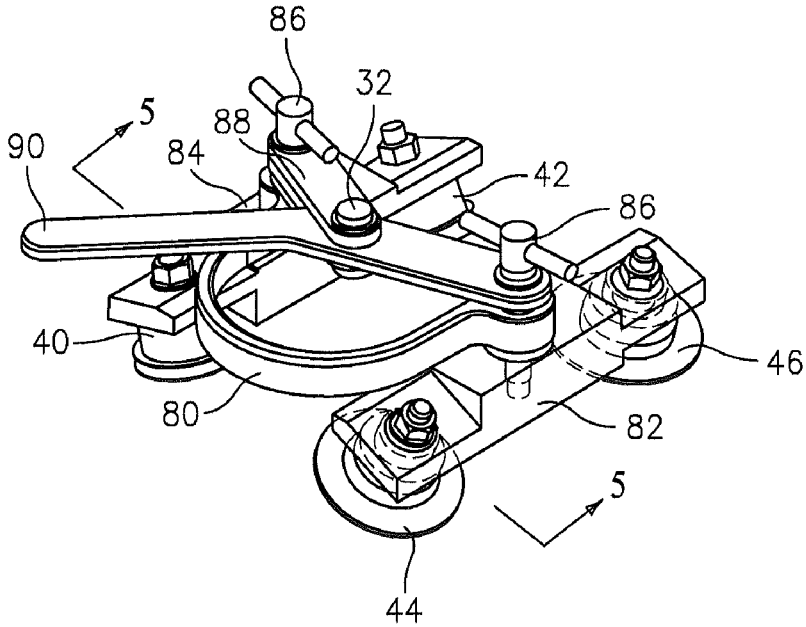
FIG. 4 is a perspective view of the lower guide.

Turning now to a detailed description of upper guide 26 and referring to FIGS. 1, 2 and 3 simultaneously, it will be appreciated that upper guide 26 includes a frame 48 upon which are articulated two handles 50 and 52. Each handle is attached to frame 48 via a pin 54 such as a cap screw and each handle 52 and 50 includes an opening 56 alignable with a through hole 58 in frame 48 through which a release pin 60 may be selectively inserted and retained. In one embodiment, the handles 50 and 52 include an undercut 61 to receive a retention arrangement 62 of release pin 60. As noted above in the FIG. 2 embodiment, the upper guide 24 is illustrated in the open position whereas in FIG. 1 it is illustrated in the closed position with release pins 60 in place. Upon each handle 50 and 52 and between a location of pin 54 and opening 56 is a wheel retention arrangement 64. The arrangement 64, in one embodiment, utilizes a socket head shoulder screw 66 and bearing 68 to pivotally retain control line insertion wheel 36 which comprises a cylindrical portion 70 and a flange portion 72 with a concavity 74, which concavity is complimentary to a control line such as control line 20 or control line 22 intended to be inserted to control line receptacle 18 by upper guide 24. It should be pointed out that FIG. 3 illustrates the control line insertion side of upper guide 24 and does not illustrate the engagement roller side of upper guide 24. The view however would be nearly identical except that concavity 74 would be substituted by a perimeter of flange 72 having no concavity. Cylinder 70 both locates flange 74 to proper location relative to the rest of the guide 24 and provides room for control line bypass in control line bypass area 76.

As was alluded to above, the upper guide 24 is intended to insert one of the plurality of control lines being mated with alternate flow path structure 14. In the illustrations herein two control lines are shown however it should be understood that more control lines could be utilized if control line receptacle were sized sufficiently to accept more than two.

Because upper guide 24 inserts only the first control line, there is a significant amount of excess room within receptacle 18. Therefore, there is no need for upper guide 24 to have any resilience. The pin structure therefore is desirable.

Once the upper guide 24 is closed and the pins 60 put in place upper guide 24 will very effectively insert one of the control lines while allowing a second control line to bypass upper guide 24 in bypass area 76. The control line that is bypassed by upper guide 24 remains outside of receptacle 18 until encountering lower guide 26 at which time it is inserted into receptacle 18 adjacent the control line that was inserted therein by upper guide 24.

Turning to lower guide 26 reference is made to FIGS. 1, 2, 4 and 5, simultaneously. Lower guide 26 operates on a spring principle to allow for tolerances in the control lines and the alternate flow path structure. Guide 26 utilizes a bow spring 80, in one embodiment, that is connected at each end thereof to a lower guide arm 82 and 84. Spring 80 is connected to the lower guide arms 82 and 84 via bow spring retainer pins 86 which are threadedly received in lower guide arms 82 and 84. In one embodiment a snap ring which is not visible is placed between the bow spring 80 and the lower guide arms 82 and 84 on the retainer pins 86 to maintain the bow spring and retainer pins as an assembly when the retainer pins are unscrewed from the lower guide arms 82 and 84, which capability is utilized when control lines 20 and 22 are to be inserted in the opposite side receptacle 18 of path structure 14 from that which is illustrated in the drawings herein. In such case, the lower guide arms 82 and 84 are swapped so that the same function of inserting a control line can be done on the opposite receptacle 18 of structure 14.

Also mounted upon retainer pins 86 is a lower guide locking arm 88 (there may be one locking arm 88 or two locking arms 88, as illustrated herein) and a lower guide handle arm 90. These arms are articulated on the retainer pins 86 and are articulated to each other at pin 32. The function of the locking arm 88 and handle arm 90 are to urge the bow spring outwardly when it is required to either engage or disengage the lower guide 26 from alternate flow path structure 14. It will be apparent from FIG. 4 that the locking arm 88 and handle arm 90 are disposed at an angle to one another at pin 32. If the handle on 90 is urged in a direction to longitudinally align locking arm 88 and handle arm 90, the distance between retainer pins 86 will grow forcing bow spring 80 to yield and forcing the control line insertion wheels 40 and 42 to grow more distant from engagement rollers 44 and 46, respectively. In one embodiment, and as illustrated, the angle of handle arm 90 is such that pin 32 will "over-center" when the handle 90 is urged toward pin 86 so that the lower guide 26 will be locked in an open position. The bow spring 80 when in the engaged position provides a resilient clamping force on the remaining uninstalled control line to urge the same into control line receptacle 18. The distinction between upper guide 24 and lower guide 26 is directly related to the number of control line versus the size of the receptacle 18. As noted above, upper guide 24 inserts a single control line into a receptacle 18 that is sized to receive more than one control line. Therefore, there is plenty of room for the control line to move in without concern for tolerance stack-up. In the illustrated embodiments herein, however, the receptacle 18 is intended to hold two control lines. Since the lower guide inserts the second control line into control line receptacle 18 tolerance stack-up is indeed an issue and must be considered. In order to avoid potential problems due to tolerance stack-up the lower guide 26 has been rendered resilient so that it can be deflected outwardly should the tolerances grow larger than expected.

Finally and importantly with respect to lower guide 26, the lower guide arms 82 and 84 are configured to provide specific axis angles for the mounting of the two control line insertion wheels 40 and 42 and the two alternate flow path structure engagement rollers 44 and 46 to ensure that the flanges of each will be positioned appropriately relative to a tangent line 90° to the axis of the wheels and rollers. In order to understand the foregoing, it is useful to identify access pin 92, roller bearing 94 and wheel 40, which comprises cylindrical portion 96, flange portion 98 and concavity 100. The wheel 40 has a base surface 102. The angle of this base surface 102 is important relative to the angle of force supplied to the control line being inserted into control line receptacle 18. In order to optimize the insertion process, it is desirable to provide forced direction vectors both inwardly to the control line receptacle 18 and in a direction toward the tubular upon which the alternate flow path structure is mounted. Utilizing a tangent line as a starting point, which line is defined perpendicular to the axis 92 of wheel 40, the desired off tangent angle for wheel 40 is between 0 degrees and about 20 degrees inclined toward the base tubular 12 and in one embodiment is about 10° under the tangent. The same is true for engagement roller 44.

Figure 5:
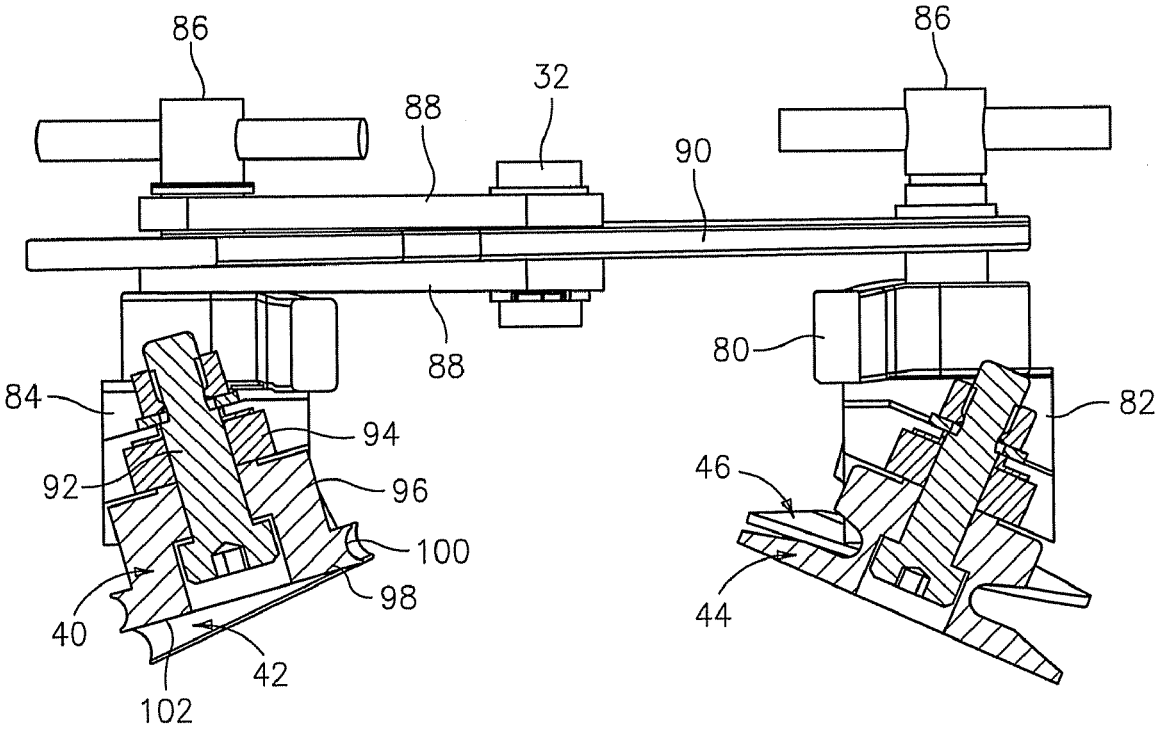
FIG. 5 is a section view of the lower guide taken along section line 5-5 in FIG. 4.

In FIG. 5 it will be easily noticed that the angles of wheel 42 and engagement roller 46 appear to be different from the angles of wheel 40 and engagement roller 44. This is an optical illusion due to the fact that the alternate flow path structure is helical on the base tubular and therefore the lower guide 26 is essentially helical in configuration which makes for the angle appearance difference. The wheel 42 and roller 46 are positioned within the same range of angles as wheel 40 and roller 44.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A system for inserting control lines to a control line receptacle at an alternate path structure attached to a tubular comprising:

an upper guide having an alternate path structure engagement roller, a control line insertion wheel and a control line bypass space;

a lower guide separate from the upper guide and having an alternate path structure engagement roller and a control line insertion wheel, the alternate path structure engagement roller and control line insertion wheel being resiliently biased to a position to cause control line insertion to the alternate path structure when the alternate path structure engagement roller is in an engaged position with the alternate path structure.

2. The system for inverting control lines to a control line receptacle at an alternate path structure as claimed in claim 1 wherein the upper guide and lower guide are distance limited relative to one another.

3. The system for inverting control lines to a control line receptacle at an alternate path structure as claimed in claim 1 wherein the system includes a control line separator.

4. The system for inverting control lines to a control line receptacle at an alternate path structure as claimed in claim 3 wherein the separator is at the upper guide.

5. A control line insertion tool for inserting control line to a control line receptacle at an alternate flow path structure attached to a tubular comprising:

a frame;

an alternate flow path structure engagement roller in operable communication with the frame;

a handle in operable communication with the frame;

a control line insertion wheel in operable communication with the handle;

a retention arrangement that in a disengaged position allows movement of the handle relative to the frame and in an engaged position, restricts movement of the handle relative to the frame.

6. The control line insertion tool for inserting control line to a control line receptacle at an alternate flow path structure as claimed in claim 5 wherein the alternate flow path structure engagement roller includes a cylindrical portion and a flange portion being extendable into the control line receptacle when the guide is mounted to the alternate flow path structure.

7. The control line insertion tool for inserting control line to a control line receptacle at an alternate flow path structure as claimed in claim 5 wherein the handle is pivotally connected to the frame.

8. The control line insertion tool for inserting control line to a control line receptacle at an alternate flow path structure as claimed in claim 5 wherein the insertion wheel is rotationally connected to the handle.

9. The control line insertion tool for inserting control line to a control line receptacle at an alternate flow path structure as claimed in claim 5 wherein the insertion wheel includes a cylindrical portion and a flange portion having a concave perimetral edge complementary to a control line to be engaged with the flange portion, the flange portion being of greater diameter than the cylindrical portion.

10. The control line insertion tool for inserting control line to a control line receptacle at an alternate flow path structure as claimed in claim 5 wherein the control line insertion motion of the insertion wheel is parallel to a line tangent to a tubular upon which the alternate flow path structure is mounted.

11. The control line insertion tool for inserting control line to a control line receptacle at an alternate flow path structure as claimed in claim 5 wherein the retention arrangement is a re-positionable pin and pin receptive recess arrangement.

12. A spring biased control line insertion tool for inserting a control line to a control line receptacle at an alternate flow path structure comprising:

a control line insertion wheel;

an alternate flow path structure engagement roller; and a biasing arrangement in operable communication with the wheel and the roller to bias the wheel and the roller toward one another to engage the alternate flow path structure and insert the control line into the control line receptacle formed at least in part by the alternate flow path structure.

13. The spring biased control line insertion tool for inserting control line to a control line receptacle at an alternate flow path structure as claimed in claim 12 wherein the tool further comprises locking arms in operable communication with the biasing arrangement and positioned to interact with the biasing arrangement to expand the arrangement in a first position and allow the arrangement to assume an unbiased position.

14. The spring biased control line insertion tool for inserting control line to a control line receptacle at an alternate flow path structure as claimed in claim 13 wherein the locking arms are articulated to each other at a first location on each arm and articulated to the biasing arrangement at a second location of each arm.

15. The spring biased control line insertion tool for inserting control line to a control line receptacle at an alternate flow path structure as claimed in claim 12 wherein the tool further comprises a frame segment having;

a body;

a first body extension positioning the control line insertion wheel at an angle of 0 degrees or greater toward a tubular upon which the alternate flow path structure is mounted in a direction of the control line.

16. The spring biased control line insertion tool for inserting control line to a control line receptacle at an alternate flow path structure as claimed in claim 15 wherein the angle is less than about 20°.

17. The spring biased control line insertion tool for inserting control line to a control line receptacle at an alternate flow path structure as claimed in claim 12 wherein the tool positions the wheel at an angle toward a tubular upon which the alternate flow path structure is mounted and in a direction toward the control line to be inserted.

18. The spring biased control line insertion tool for inserting control line to a control line receptacle at an alternate flow path structure as claimed in claim 12 wherein the tool further includes a second control line insertion wheel and a second alternate flow path structure engagement roller.

19. The spring biased control line insertion tool for inserting control line to a control line receptacle at an alternate flow path structure as claimed in claim 18 wherein the insertion wheel and the second insertion wheel are angled similarly to each other.

20. A method for inserting a plurality of control lines to a control line receptacle formed at least in part by an alternate flow path structure attached to a tubular comprising:

separating a plurality of control lines supplied from a remote source;

engaging one of the plurality of control lines with a control line insertion wheel of an upper control line guide and urging the engaged control line into the control line receptacle;

bypassing at least one other control line of the plurality of control lines with the insertion wheel of the upper control line guide;

engaging one control line of the at least one other control line with a control line insertion wheel of a lower control line guide and urging the one control line of the at least one other control line into the control line receptacle.

21. A method for inserting a plurality of control lines to a control line receptacle at an alternate flow path structure as claimed in claim 20 wherein the urging by the lower control line guide is in a direction toward the control line receptacle and with a direction vector toward a tubular upon which the alternate flow path structure is mounted.

* * * * *